US011345006B2

(12) United States Patent
Boughan et al.

(10) Patent No.: US 11,345,006 B2
(45) Date of Patent: May 31, 2022

(54) APPARATUS AND METHOD FOR INSTALLING GROMMETS IN A VEHICLE

(71) Applicant: Honda Motor Co., Ltd., Tokyo (JP)

(72) Inventors: Emma Boughan, Dublin, OH (US); Benjamin A. Holtsberry, North Lewisburg, OH (US); Phillip Michael Gonzales, Columbus, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 162 days.

(21) Appl. No.: 16/821,270

(22) Filed: Mar. 17, 2020

(65) Prior Publication Data

US 2021/0291333 A1 Sep. 23, 2021

(51) Int. Cl.
*B25B 27/00* (2006.01)
*B25B 27/28* (2006.01)

(52) U.S. Cl.
CPC ..... *B25B 27/28* (2013.01)

(58) Field of Classification Search
CPC ..... B25B 27/00; B25B 27/02; B25B 27/14; B25B 27/26; B25B 27/306
See application file for complete search history.

(56) References Cited

U.S. PATENT DOCUMENTS 2,468,286 A 4/1949 Behlert
2,582,248 A 1/1952 Gookin
4,589,575 A * 5/1986 Rigberg ..... B65D 83/0418 206/535
5,071,033 A * 12/1991 Siwek ..... B65D 83/0409 221/229
5,178,298 A * 1/1993 Allina ..... B65D 83/0418 206/457
5,785,206 A * 7/1998 Chan ..... G07F 11/14 221/198
8,272,113 B1 9/2012 Marks
2021/0291333 A1* 9/2021 Boughan ..... B25B 27/0035

FOREIGN PATENT DOCUMENTS

DE 3606113 C2 7/1997
WO 0236282 A1 5/2002

OTHER PUBLICATIONS

Valve Cotter Removal Tool, https://shop.kiwav.com/products/valve-keeper-cotter-removal-installation-tool-for-motorcycle-2v-engine-steel-red-spring-loaded.

* cited by examiner

*Primary Examiner* — Lee D Wilson
(74) *Attorney, Agent, or Firm* — Kenealy Vaidya LLP

(57) ABSTRACT

The disclosed subject matter includes an installation tool for sequentially mounting each of a plurality of grommets in an opening of a vehicle panel and related methods. The installation tool can include a receptacle including a case defining a storage space configured to accommodate the plurality of grommets. The receptacle can include an opening in communication with the storage space, the opening configured to hold a respective one of the grommets in an installation position in which a first portion of one of the grommets protrudes through the opening and a second portion of the respective one of the grommets is located in the storage space. A biasing structure can be movably mounted in the case and configured to bias each of the grommets in the storage space toward the installation position.

17 Claims, 7 Drawing Sheets

APPARATUS AND METHOD FOR INSTALLING GROMMETS IN A VEHICLE

BACKGROUND

The disclosed subject matter relates to a spring-loaded grommet installation tool. More particularly, the disclosed subject matter relates to methods and apparatus that install grommets with a simple motion by a spring.

A grommet can be used to seal an opening in a vehicle structure such as a body panel, a door panel, or a frame member. A grommet can also form a seal between a vehicle panel and a wire harness that extends through a hole in the vehicle panel.

A vehicle can include a plurality of grommets spaced around the vehicle and located in apertures of various vehicle structures, such as vehicle panels. During manufacture of the vehicle on a moving assembly line, it can be advantageous to install a plurality of grommets at a single workstation of the assembly line. The grommets can be installed manually or by an automated process using a robot or other automated machine. Manual installation can be inefficient because one or more of the installation locations can be difficult to reach manually and/or difficult to manually confirm that each grommet has been installed according to the specification requirements. It is possible that a robot can more readily access each mounting location and confirm the desired installation. Thus, a robot can decrease the cycle time for installing the grommets and consistently confirm the quality of the installation. However, in the event that a robot is malfunctioning, or a robot is not used for a particular application, there is a need for a manual grommet installation tool and method that are easy to use, ergonomic, and consistent in application and use.

SUMMARY

Some embodiments of the disclosed subject matter are directed to an installation tool for sequentially mounting each of a plurality of grommets in an opening or aperture of a vehicle panel. The installation tool can include a receptacle including a case defining a storage space configured to accommodate the plurality of grommets. The receptacle can include an opening provided in communication with the storage space, the opening configured to hold a respective one of the grommets in an installation position in which a first portion of the respective one of the grommets protrudes through the opening and a second portion of the respective one of the grommets is located in the storage space. A biasing structure can be movably mounted in the case and configured to bias each of the grommets in the storage space toward the installation position.

Some embodiments of the disclosed subject matter are directed to an installation tool for installing a plurality of grommets into a hole in a vehicle panel. Each of the grommets can include a first portion that is configured to pass through the hole in the vehicle panel and a second portion that opposes the first portion and is configured to engage the vehicle panel such that the vehicle panel is sandwiched between the first portion and the second portion of the grommet. The installation tool can include a grommet receptacle that has a longitudinal axis and includes a first end and a second end spaced apart along the longitudinal axis. A storage space can be configured to accommodate the plurality of grommets between the first end and the second end and aligned along the longitudinal axis. An opening can be provided in the first end and in communication with the storage space, the opening configured to hold a respective one of the grommets in an installation position in which the first portion of the respective one of the grommets protrudes through the opening and the second portion of the respective one of the grommets is located in the storage space. A biasing member can abut the second end of the grommet receptacle and be configured to bias the grommets toward the opening.

Some additional embodiments are directed to a method for installing grommets onto a vehicle. The method can include providing an installation tool that includes a receptacle and an opening at a first end, loading a plurality of grommets into the installation tool, inserting a first of the grommets into a first aperture in a panel of the vehicle, removing the installation tool from the panel after inserting the first grommet in the first aperture in the panel such that the first grommet remains in the first aperture in the panel of the vehicle, inserting a second of the grommets into a second aperture in the panel of the vehicle, and removing the installation tool from the panel after inserting the second grommet in the first aperture in the panel such that the second grommet remains in the second aperture in the panel of the vehicle.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

Figure 1:
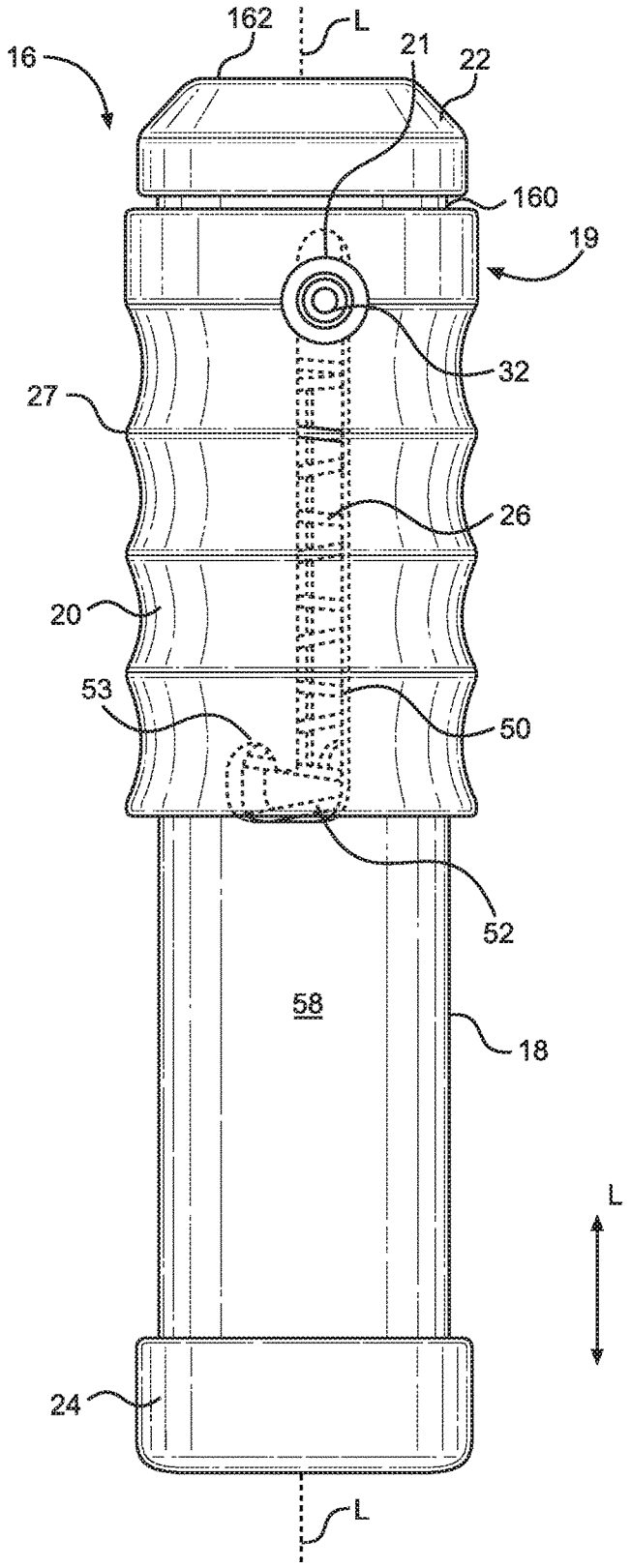
FIG. 1 is a plan view of an installation tool made in accordance with principles of the disclosed subject matter.
Figure 2:
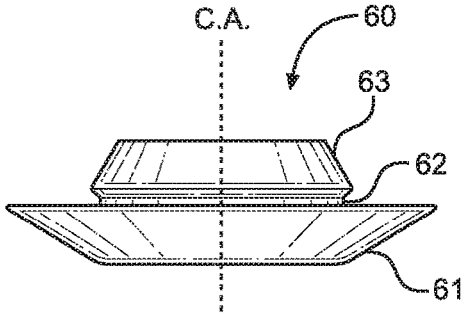
FIG. 2 is a plan view of a grommet used in the installation tool of FIG. 1.

FIG. 1 illustrates an embodiment of an installation tool 16 made in accordance with principles of the disclosed subject matter. The installation tool 16 can be used to install a plurality of grommets 60 onto a vehicle 10 one at a time. FIG. 2 illustrates an exemplary embodiment of a grommet 60 that can be installed by the installation tool 16 of FIG. 1.

Figure 3:
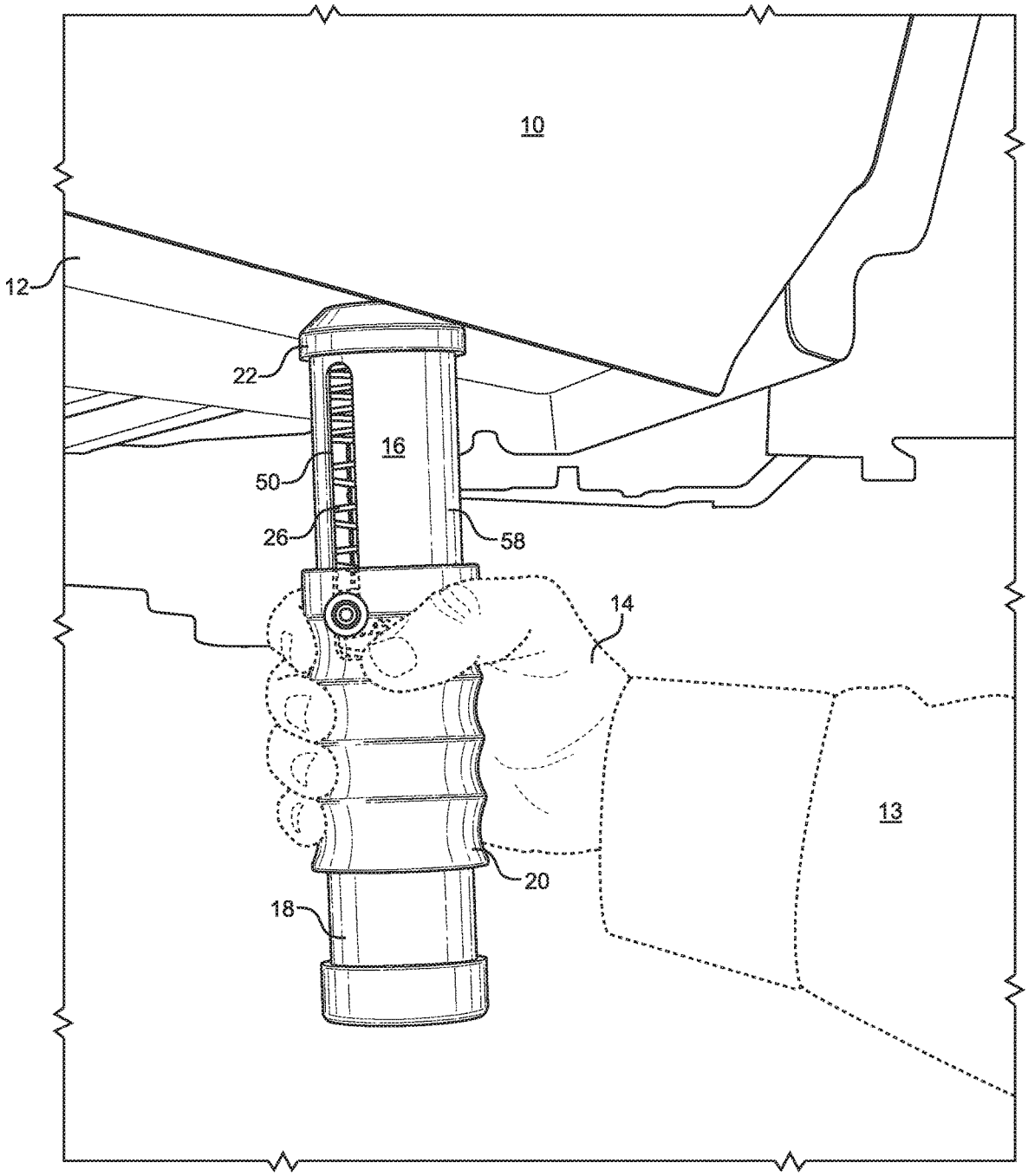
FIG. 3 is a perspective view of a user operating the installation tool of FIG. 1 on a vehicle.

Referring to FIG. 3, the plurality of grommets 60 can be installed on the vehicle 10 at a single workstation of a moving assembly line. When the grommets 60 are normally installed by an automated process such as with a robot, it can be possible that the robot is unavailable to perform the installation process. In this exceptional case, manual installation of each of the grommets 60 onto the vehicle 10 can occur. This can be a time-consuming and labor-intensive process. The installation tool 16 can be used on a vehicle assembly line to increase the efficiency of the manual installation of a plurality of grommets 60 onto each vehicle 10 that passes through the workstation.

The installation tool 16 can be configured to contain a plurality of the grommets 60 that corresponds to the number of grommets 60 to be installed at the workstation of the assembly line. The installation tool 16 can be configured to dispense each grommet 60 one at time so that the user 13 can install each grommet 60 one at a time into an aperture of a panel 12 of the vehicle 10.

Referring to FIG. 2, each grommet 60 can include a first flange 61, a shank 62 and a second flange 63. The installation tool 16 can be configured to place each grommet 60 individually into a ready position in the installation tool 16 such that the second flange 63 is located outside of the installation tool 16 and the first flange 61 is held inside of the installation tool 16. The user 13 can use the installation tool 16 to insert the second flange 63 of each grommet 60 into and through a hole in the vehicle panel 12 such that the vehicle structure that surrounds the hole is sandwiched between the first flange 61 and the second flange 63. The installation tool 16 can be configured to automatically release the grommet 60 when the vehicle panel 12 is sandwiched between the flanges 61, 63 and the user 13 moves the installation tool 16 away from the vehicle panel 12. This release can occur without activating any mechanism such as but not limited to a trigger or a release button. Further, the installation tool 16 can be configured to permit the user 13 to orient the installation tool 16 in a direction that allows the user 13 to apply a force against the grommet 60 in order to push the grommet 60 into the hole (and pull the tool 16 away to release the grommet 60). After the user 13 removes the installation tool 16 from the installed grommet 60, the installation tool 16 can automatically (e.g., via spring force) load the next grommet 60 into the ready position and the user 13 can repeat the process for each subsequent grommet 60.

Thus, the installation tool 16 can be advantageously implemented at a workstation of a moving assembly line where a repetitive task is performed manually. Further, the installation tool 16 can enhance the ease with which the user 13 can install the grommets 60, using a simple back and forth force with no additional step of unlocking or actuating a trigger or lever, etc., to release or install each grommet 60.

Figure 4:
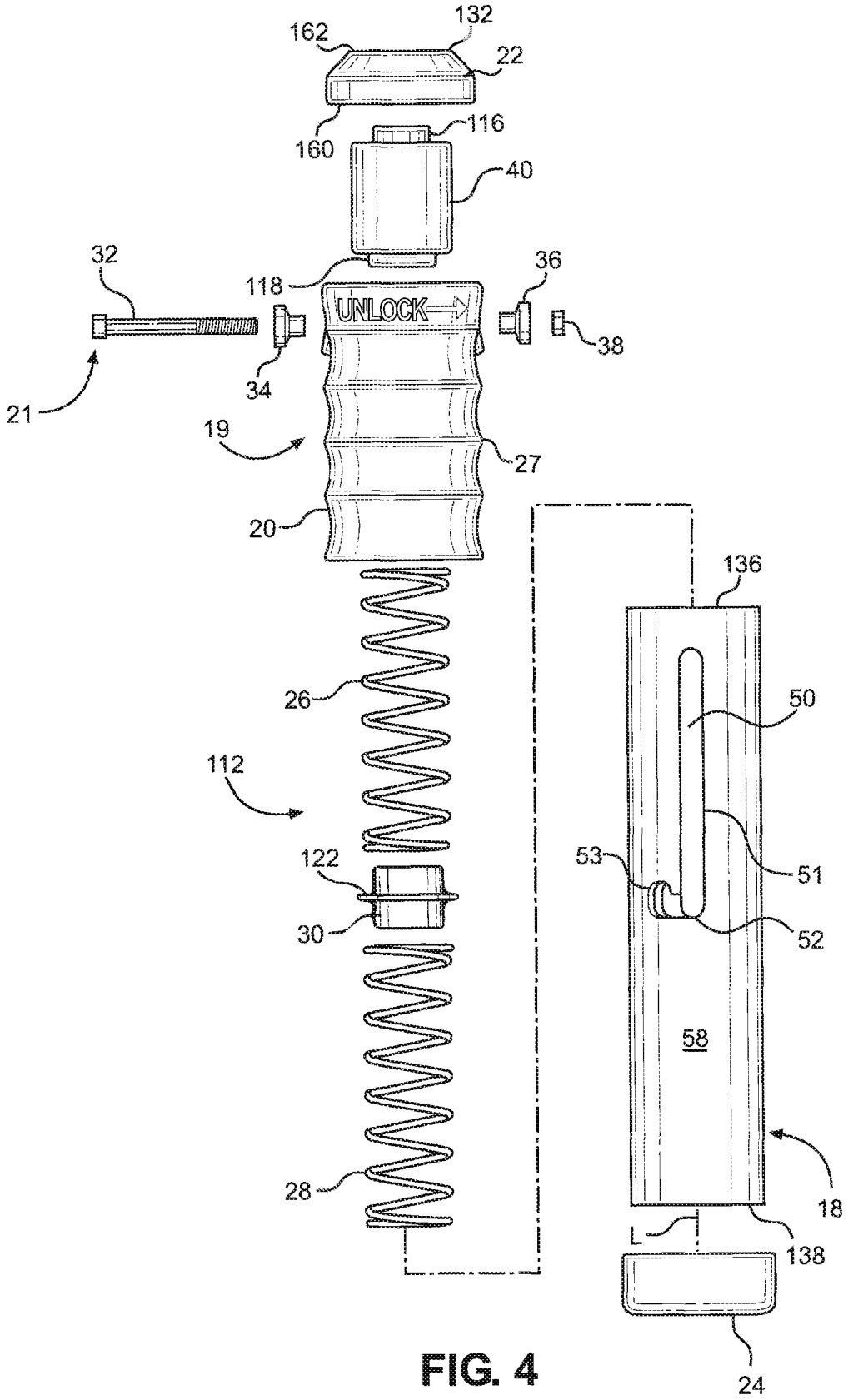
FIG. 4 is an exploded plan view showing components of the installation tool of FIG. 1.
Figure 5:
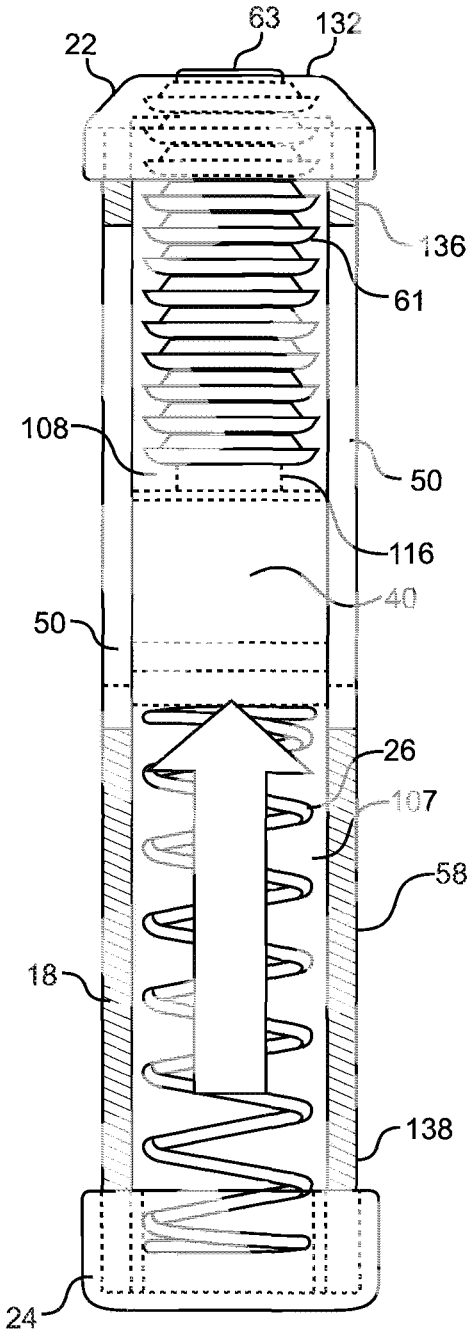
FIG. 5 is a cross-sectional view of the installation tool of FIG. 1 in a first position.
Figure 6:
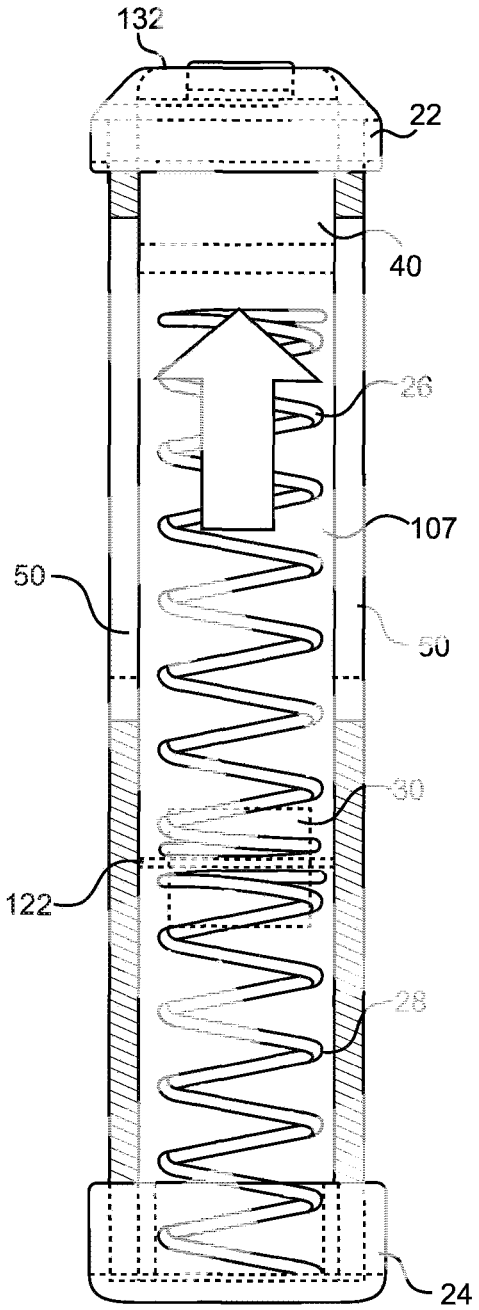
FIG. 6 is a cross-sectional view of the installation tool of FIG. 1 in a second position.

The installation tool 16 can include a grommet receptacle, a biasing structure, and a locking structure. Referring to FIGS. 1 and 3-8, the grommet receptacle can include a case 18, a first cap 22, and a second cap 24. The grommet receptacle can be configured to contain the plurality of grommets 60, hold the grommets 60 one at a time in the ready position, and dispense the grommets 60 one at a time. Referring to FIGS. 4-6, the biasing structure can include a plug 40, a first spring 26, a second spring 28, and a spring adapter 30. The bias structure can be configured to urge the grommets 60 one at a time into the ready position. The locking structure can include a grip 19, a slot 50, and a guide 21. The locking structure can be configured to lock the biasing structure in state such that the biasing structure does not act on the grommets 60 while the user 13 loads/inserts the plurality of grommets 60 into the installation tool 16.

Regarding the grommet receptacle, the case 18 can be a hollow cylindrical tube with a cylindrical outer surface 58, a first end 136 and a second end 138. Referring to FIG. 4 the first cap 22 can have an opening 132, and the first cap 22 can be attached to the first end 136 of the case 18. As will be described in detail below, the opening 132 can be configured to allow the biasing structure to push the second flange 63 of the grommet 60 through the opening 132. Further, the first cap 22 can include an inner surface that is configured to engage the first flange 61 of the grommet 60 to hold the grommet 60 in the ready position until the grommet 60 is installed on the vehicle 10. The second cap 24 can be attached to and close the second end 138 of the case 18. The caps 22, 24 and the case 18 can form internal space 108 when the caps 22, 24 are attached to the case 18.

Referring to FIGS. 4-6, the springs 26, 28, the spring adapter 30 and the plug 40 of the biasing structure can be contained in the internal space 108 of the grommet receptacle. The first spring 26 can be sandwiched between (and possibly attached to) the plug 40 and the spring adapter 30. The second spring 28 can also be sandwiched between (and possibly attached to) the spring adapter 30 and an end wall of the second cap 24. Grommets 60 can be loaded onto the plug 40 and centered thereon by a first projection 116 that rests inside a lower opening of the grommet 60. The lower opening of the grommet 60 can have a circular diameter that is approximately equal to an outer peripheral diameter of the first projection 116.

Regarding the locking structure, the slot 50 can be formed on opposite sides of the outer surface 58 of the case 18. The slider sleeve 20 can also be located on the outer surface 58 of the case 18. The guide 21 can be attached to the sleeve 20 and the plug 40 (and possibly the spring 26). The guide 21 can allow the sleeve 20 and the plug 40 to move concurrently along the slot 50. Thus the guide 21 can allow the sleeve 20 and the plug 40 to move between a first slot position and a second slot position. The sleeve 20, the guide 21, and the plug 40 can have movement restricted (locked) at the second slot position. At the second slot position, the plug 40 is furthest from the opening 132 of the first cap 22. As a result, a maximum free space is created in the storage space 108 between the plug 40 and the opening 132 of the first cap 22. In this position, a user 13 can load the plurality of grommets 60 into the maximum free space. The user 13 can use their hand 14 to push grommets 60 through the opening 132 of the first cap 22 (or the user can remove first cap 22 and insert the grommets 60 through an open first end 136 of case 18). The user 13 can repeat this action until a plurality of grommets 60 are loaded between the plug 40 and the opening 132 of the first cap 22. The first cap 22 can hold a grommet 60 at a ready position. The grommet 60 can have a first flange 61, a shank 62, and a second flange 63. The first flange 61 can extend about a diametrical periphery from the shank 62. The second flange 63 can also extend about a diametrical periphery from a lower portion of the shank 62.

The second flange 63 can have an outermost diameter about a central axis C.A. of the grommet 60 that is greater than an outermost diameter of the shank 62 about the same central axis C.A. of grommet 60. The second flange 63 can have an outermost diameter about the central axis C.A. of grommet 60 that is less than the outermost diameter of the first flange 61 about the central axis C.A. The opening 132 of the first cap 22 can have a diameter that is equal to or greater than the outermost diameter of either the shank 62 or the second flange 63, but less than the outermost diameter of the first flange 61. At the ready position, the second flange 63 extends out of the opening 132 of the first cap 22 while the first flange 61 abuts the inside of the first cap 22. To install the grommets 60, the user 13 can raise the installation tool 16 to the surface 12 of the vehicle 10. The user 13 can then push the second flange 63 of the grommet 60 into an aperture in a panel on the surface 12 of the vehicle 10. Then, the user 13 can remove the installation tool 16 from the panel of the surface 12 of the vehicle 10 which will cause the flange 61 to deform or flex to allow the individual grommet 60 to be removed from the installation tool 16 via opening 132. The biasing structure will then use the spring bias of the springs 26, 28 to place the next grommet 60 in the ready position.

Figure 9:
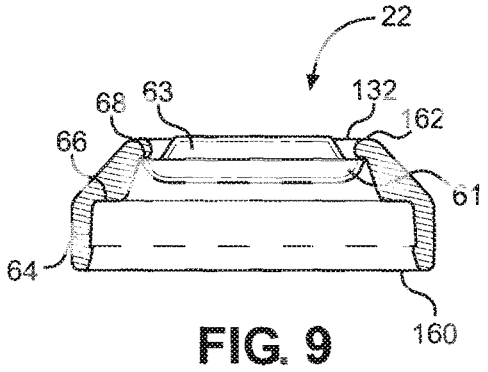
FIG. 9 is a cross-sectional view of a first cap of the installation tool of FIG. 1

Referring to FIGS. 5 and 9, collectively, the grommet receptacle can include the first cap 22, the second cap 24, and the case 18. In an exemplary embodiment, the first cap 22 can have a bottom edge 160 and a top edge 162. The top edge 162 of the first cap 22 can feature the opening 132. The opening 132 can be an aperture that has a diameter greater than the outermost diameter of second flange 63 of the grommet 60. The diameter of opening 132 can also be greater than the outermost diameter of shank 62 of the grommet 60. The first cap 22 can have a plurality of inner surfaces, including an inner cylindrical surface 64 that extends from the bottom edge 160 upward. An inner radial surface 66 can extend from the cylindrical surface 64 at a right angle. An inner concave contact surface 68 can extend from the radial surface 66 at an acute angle. The concave contact surface 68 can extend to the top edge 162 of the first cap 22. Thus, first cap 22 can be hollow and include a variety of shaped internal surface that provide an adequate amount of friction to the grommet 60 in order to retain the grommet 60 within the tool 16 against spring force of springs 26, 28, while allowing the grommet 60 to be ejected from the tool 16 when attached to an aperture of a vehicle.

The cylindrical surface 64 can have a diameter that is greater than the diameter of outer surface 58 of the case 18. The cylindrical surface 64 can be attached to the first end 136 of the case 18 via any appropriate manner such as but not limited to a friction fit, a threaded connection, adhesive, welding or mechanical fasteners.

During installation, the second flange 63 can be the first part of the grommet 60 to enter an aperture in a surface 12 of a vehicle 10, in order to fill/conceal the aperture. The grommet 60 can be made of any appropriate material, such as plastic, rubber or another elastomer material. The flanges 61, 63 and the shank 62 can have curved ring shapes or mushroom umbrella shapes or other shape that provides the desired frictional fit within the tool 16 and within the aperture in vehicle 10 when installed therein.

When in a ready position, the second flange 63 of the grommet 60 can protrude from the opening 132 of the first cap 22. The second flange 63 can be the first part of the grommet 60 that makes contact with an aperture in a surface 12 of the vehicle 10. The ready position is when the second flange 63 protrudes from the opening 132 of the first cap 22 and the first flange 61 is in contact with the concave contact surface 68 of the first cap 22. Thus, the ready position is when a grommet 60 is ready to be installed in an aperture of a panel in the panel 12 (or other surface or structure) of the vehicle 10.

Figure 10:
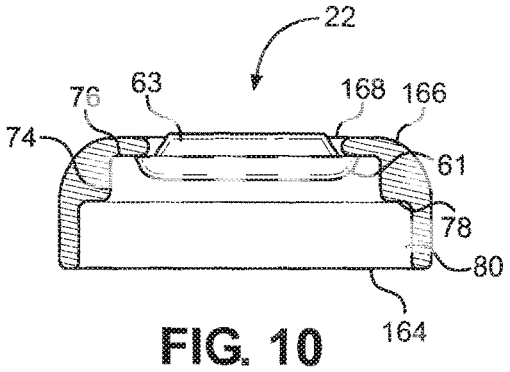
FIG. 10 is a cross-sectional view of an alternate embodiment of a first cap of the installation tool of FIG. 1.

In an alternate embodiment, referring to FIG. 10, a first cap 22 can have a bottom edge 164 and a top edge 166. The top edge 166 of the first cap 22 can feature an opening 168. The opening 168 can be an aperture that has a diameter greater than an outermost diameter of each of the second flange 63 and the shank 62 of the grommet 60. The opening 168 can have a diameter that is less than an outermost diameter of the first flange 61 of the grommet 60. The first cap 22 can have multiple inner surfaces that can include a cylindrical surface 80, a radial surface 78, a second cylindrical surface 74, and a second radial surface 76. The cylindrical surface 64 can extend upward from the bottom edge 164. The radial surface 66 can extend from the cylindrical surface 64, and the second cylindrical surface 74 can extend from the radial surface 66, and the second radial surface 76 can extend from the second cylindrical surface 74. The second radial surface 76 can extend to the top edge 166 of the first cap 22. The grommet 60 can be in contact with the second radial surface 76 when in the ready position. The first cap 22 can be attached by any appropriate means with the first end 136 of the case 18.

Referring to FIGS. 4 and 5, collectively, the second cap 24 can have a first end with a diameter that is greater than an outer diameter of the case 18. The first end of the second cap 24 can be attached to the case 18 via threads, friction fit, adhesive, welding, or other known attachment method or structure. The second end of the second cap 24 can have a floor wall and the second spring 28 of the biasing structure 112 can abut the floor wall of the second cap 24. When the springs 26, 28 are in compression, the reactive forces can act on the second end of the second cap 24 and grommets 60.

Figure 11:
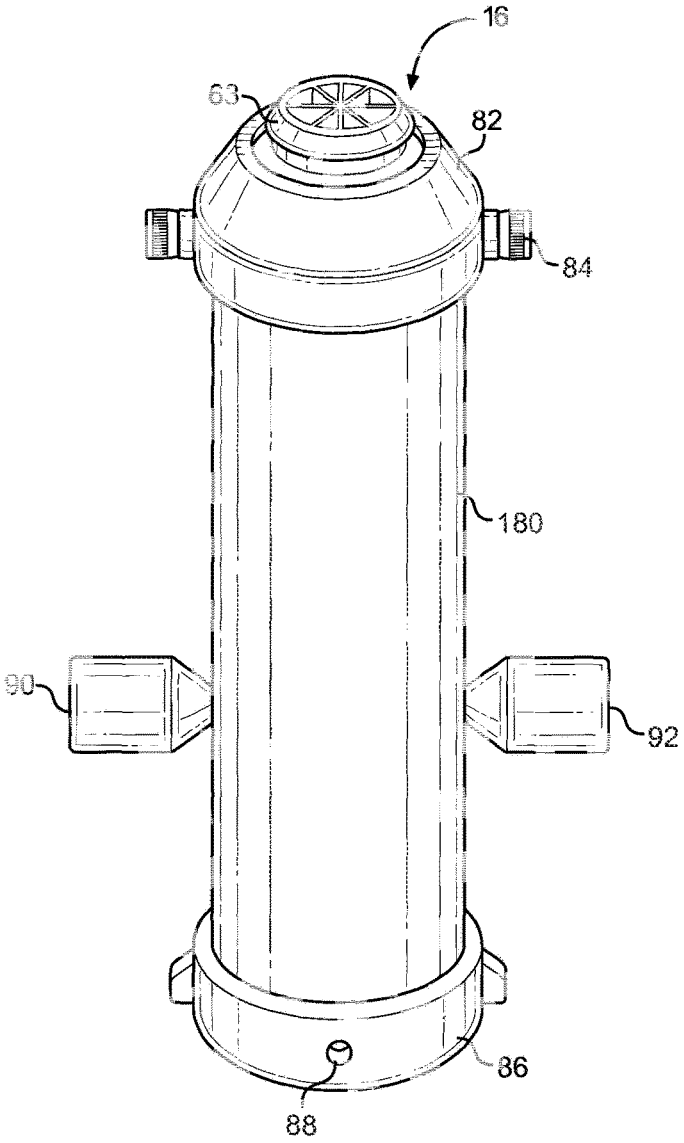
FIG. 11 is a perspective view of an alternate embodiment of the installation tool made in accordance with principles of the disclosed subject matter.
Figure 13:
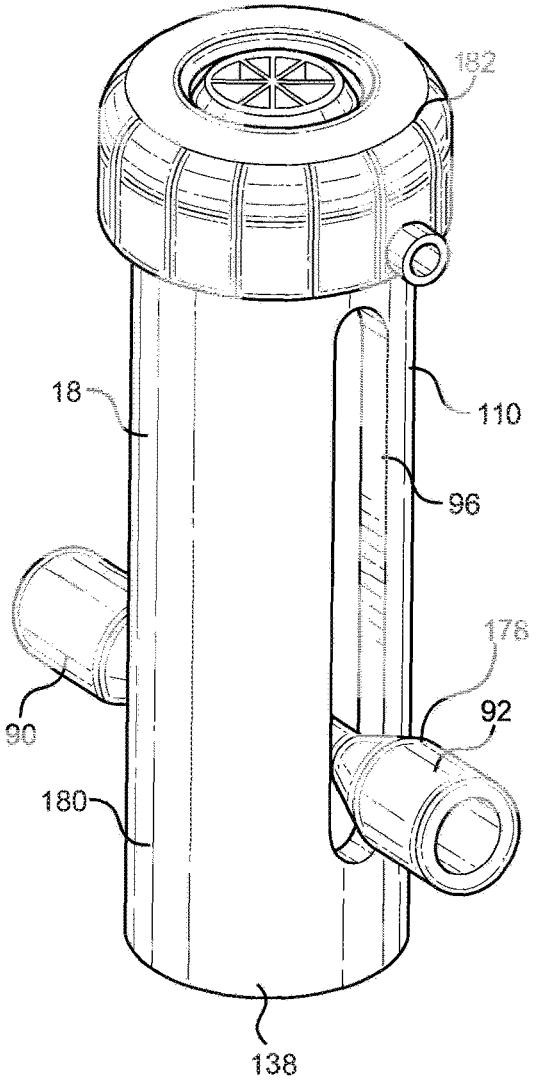
FIG. 13 is a perspective view of yet another alternate embodiment of an installation tool made in accordance with principles of the disclosed subject matter.

In an alternate embodiment, shown in FIG. 11, a second cap 86 is fastened to the case 180 via a bolt 88, and a first cap 82 is connected to case 180 via set screws 84. Referring to FIG. 13, in another alternate embodiment, the case 18 can have an integral floor wall at the second end 138 of the case 18. In this exemplary embodiment, the grommet receptacle 110 does not have a second cap 24.

The storage space 108 can be made from the space created when the first cap 22, the case 18, and the second cap 24 are assembled. The storage space 108 can be a three-dimensional space bound inside the cylindrical inner surface of the case 18. The storage space 108 can be bound between the first and second caps 22, 24. The storage space 108 is the three-dimensional space where the plurality of grommets 60 and the biasing structure are located. The storage space 108 can be any appropriate shape in which the plurality of grommets 60 can fit.

Referring to FIG. 4, the biasing structure 112 can include a plug 40, a first spring 26, a spring adapter 30, and a second spring 28.

The first spring 26 can be any type of spring such as but not limited to a coil spring. The first spring 26 can have a first end attached to (or abutting) the spring support 118 of the plug 40. A second end of the first spring 26 can be attached to (or abut) a spring adapter 30. The second spring 28 can be any type of spring such as but not limited to a coil spring. The second spring 28 can have a first end attached to (or abutting) the spring adapter 30 and a second end attached to (or abutting) a lower surface of case 18 (e.g., cap 24).

In an exemplary embodiment, the spring adapter 30 can have a main cylindrical body with an engagement surface 122 attached to the main body. The engagement surface 122 can extend about a perimeter of the center of the cylindrical main body of the spring adapter 30. The diameter of the engagement surface 122 can be greater than the diameter of the main body of the spring adapter 30. The first spring 26 can engage with a first side of the engagement surface 122. The second spring 28 can engage with a second side of the engagement surface 122. The spring adapter 30 can facilitate movement of the first spring 26 relative to the second spring 28. During compression of the springs 26, 28, the engagement surface 122 of the spring adapter 30 can prevent the coils of the first spring 26 from being entangled with the coils of the second spring 28. The spring adapter 30 can be a coil spring spacer that adds height or stiffness to a coil spring suspension.

The locking structure can include a slot 50, a grip 19, and a guide 21.

The slot 50 can be located on the cylindrical outer surface 58 of the case 18. In an exemplary embodiment, the slot 50 can have a straight part 51, a circumferential part 52, and a lock part 53. The straight part 51 can extend along the longitudinal axis L of the case 18. The straight part 51 can have any appropriate predetermined length. In an exemplary embodiment, the straight part 51 can extend at a length that is less than half of an entire length of the case 18. The straight part 51 can be a through-hole. The straight part 51 can have a first end and a second end. The first end of the straight part 51 can have a semicircle shape. The first end of the straight part 51 can be spaced away from the first end 136 of the case 18. The second end of the straight part 51 can be connected to the circumferential part 52. The circumferential part 52 can extend in the circumferential direction of the case 18. The circumferential part 52 can be continuous with the straight part 51. The width of the circumferential part 52 can be any appropriate width. In an exemplary embodiment, the circumferential part 52 and the straight part 51 have an equal width. The circumferential part 52 can have a first end connected to the straight part 51. A second end of the circumferential part 52 can be connected to the lock part 53. The lock part 53 can extend in a direction parallel to the longitudinal axis L of the case 18. The lock part 53 can extend from the circumferential part 52 at an angle. The lock part 53 is spaced away from the straight part 51. The lock part 53 can extend towards the opening along the longitudinal axis. The lock part 53 can extend in a direction that is parallel to the straight part 51 (and the longitudinal axis L). The lock part 53 can have a length that is less than the length of the straight part 51. The lock part 53 can be continuously connected to the circumferential part 52 and have a width that is the same as the width of the circumferential part 52. The lock part 53 can have a first connected to the circumferential part 52 and a second end formed in a semicircle shape. The case 18 can have a single slot 50 or a plurality of slots 50. In an exemplary embodiment, the case 18 can have two slots 50. The two slots 50 can be placed at opposing positions on an outer surface of the case 18. The circumferential parts 52 of the two slots 50 can extend in opposite circumferential directions along the case 18. The lock parts 53 can be diametrically opposed to each other.

The guide can include a bolt 32, a first slider spacer 34, a second slider spacer 36, and a nut. The first slider spacer 34 can be located near first slot 50. The second slider spacer 36 and the nut 38 can be located near a second slot 50. The bolt 32 can extend through each of: the slider sleeve 20, the spacers 34, 36, the nut 38, the plug 40, and the two slots 50. The dimensions of the bolt 32 allow the bolt 32 to travel along the slot 50. The bolt 32 can fix the slider sleeve 20 and the plug 40 together.

Figure 7:
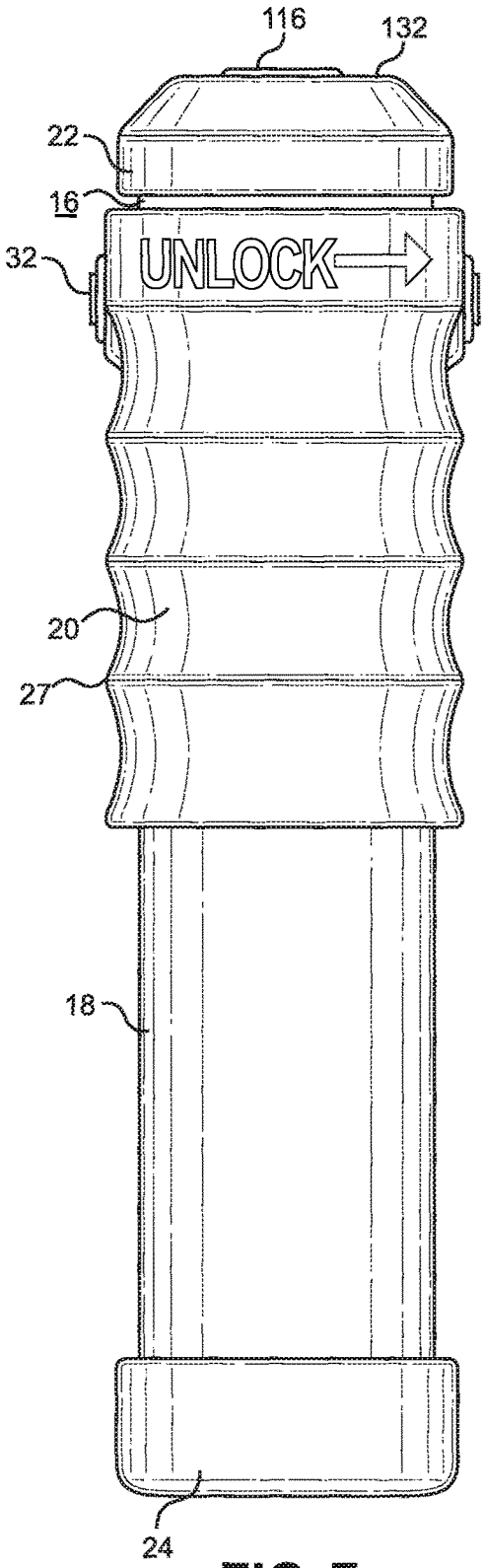
FIG. 7 is a plan view of the installation tool of FIG. 1 with a sliding sleeve in an unlocked position.
Figure 8:
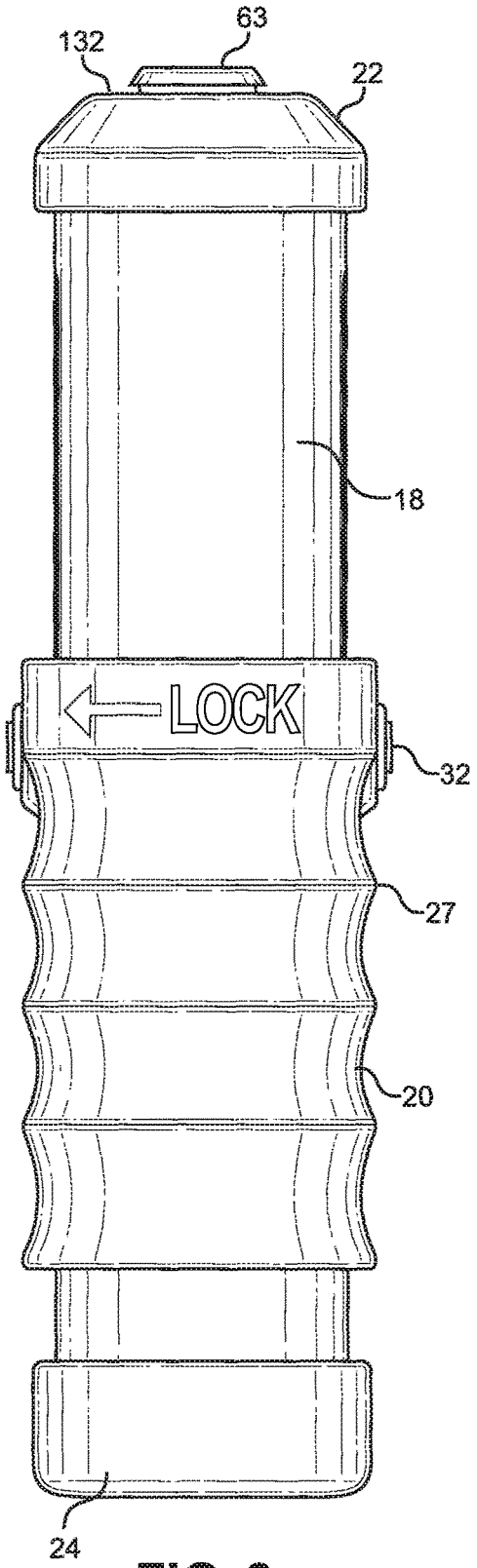
FIG. 8 is a front view of the installation tool of FIG. 1 with the sliding sleeve in a locked position.

Referring to FIGS. 4, 7, and 8, collectively, in an exemplary embodiment the grip 19 can be a slider sleeve 20. The slider sleeve 20 can be a hollow cylinder and can have a pattern of grooves 27 that are configured for a user's hand 14 to grip. The slider sleeve 20 can move between an unlock position and a lock position. Specifically, the tool 16 can be considered to be in the lock position when the bolt 32 is in the lock part 53 of the slot 50. A user 13 can put the installation tool 16 in the lock position by moving the slider sleeve 20 downward relative to and along the longitudinal axis L of the case 18. When the bolt 32 arrives at the circumferential part 52 of the slot 50, the user 13 can then twist the slider sleeve 20 about the longitudinal axis L, so that the bolt 32 enters the circumferential part 52 of the slot 50. When the bolt 32 reaches an end of the circumferential part 52, the user 13 can then move the slider sleeve 20 slightly upward along the longitudinal axis L of the case 18 in a direction towards the first end 136 of the case 18. This movement can position the bolt 32 into the lock part 53 of the slot 50. The unlock position can be any position in which the bolt 32 is not positioned in either the circumferential part 52 or the lock part 53 of the slot 50 (e.g., when bolt 32 is located in straight part 51 of slot 50 the tool 16 is considered in the unlock position).

Figure 12:
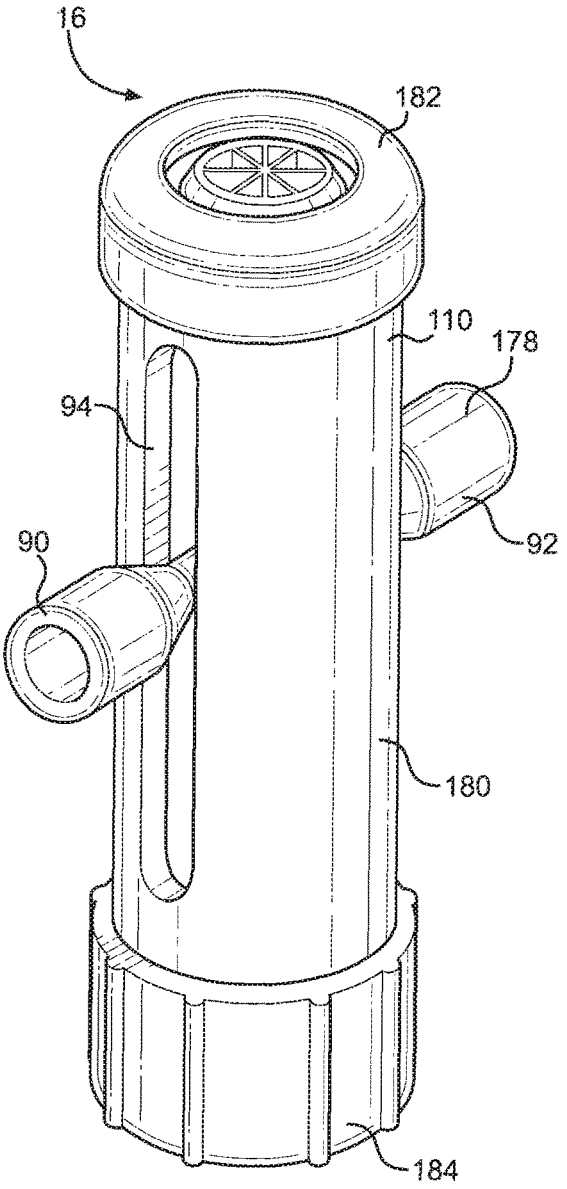
FIG. 12 is a perspective view of another alternate embodiment of an installation tool made in accordance with principles of the disclosed subject matter.

In an alternate embodiment, referring to FIGS. 12 and 13, the installation tool 16 can have a grommet receptacle structure, a biasing structure, and a locking structure. The grommet receptacle structure can include a case 180, a first cap 182, and a second cap 184. The biasing structure can include the plug 40, the first spring 26, the second spring 28, and the spring adapter 30 all located within a lower spring storage space 107. The locking structure can include slots 94, 96, a guide, and a grip. The slots 94, 96 can include a first straight slot 94 and a second straight slot 96. The guide can be a bolt 178 that can move along the slots 94, 96. The grip can be a plurality of handles 90, 92. A first handle 90 can be connected to the part of the bolt 32 that protrudes through the first straight slot 94. A second handle 92 can be connected to the part of the bolt 32 that protrudes through the second straight slot 96. This embodiment does not have a lock position. The user 13 can push and pull the handles 90, 92 to alter the biasing structure 112 in the grommet receptacle 110.

While certain embodiments of the invention are described above, it should be understood that the invention can be embodied and configured in many different ways without departing from the spirit and scope of the invention.

Referring to FIG. 4, a single spring can be used, instead of two separate springs 26, 28 and a spring adapter 30. The slot 50 can also be in the slider sleeve 20 and projections in the case 18 can slide in the slots 50 of the sleeve 20.

The slider sleeve 20 can be formed in various other manners such as a grip, holder, etc. in order to operate the installation tool 16.

The installation tool 16 and its components can be manufactured in many different ways, including injection molding, casting, extrusion molding, 3D printing, machining, etc. Each of the installation tool 16 components can be constructed from various materials including metals, plastics, rubbers, wood, ceramics, and Polyvinyl chloride (PVC) parts. The material can be determined based on the specific application for the tool 16. For example, the case 18 can be made from steel or magnetized material if it is desired to hang the tool 16 using magnetic forces. Of course, lightweight materials such as plastics may be preferable for operational ergonomic perspectives.

According to the method of use, a user can initially place the topmost grommet 60 located in the ready position in the first cap 22 of tool 16 in contact with a rim of an aperture in a vehicle panel 12. The user then applies an upward linear force along the longitudinal axis L of the tool 16 that is transferred along a chain of grommets 60 located in the receptacle 110. Once enough force is exerted, the topmost grommet will "pop" into the aperture in the vehicle structure such that the $2^{nd}$ flange 63 of the grommet 60 is located on an interior side of the vehicle panel structure, while the $1^{st}$ flange 61 of the grommet remains an exterior side of the vehicle panel structure (along with tool 16). The user then applies a downward linear force along the longitudinal axis L of the tool 16 until enough force is exerted such that the $1^{st}$ flange 61 "pops" out of the opening 132 of the first cap 22. The spring force of springs 26, 28 will then cause a next grommet 60 in the chain of grommets 60 to extend out of the opening 132 in a ready/installation position for next use. The user is only required to exert force along a single axis (upward and then downward with respect to the longitudinal axis L of the tool 16).

What is claimed is:

1. An installation tool for sequentially mounting each of a plurality of grommets in an opening of a vehicle panel, the installation tool comprising:

a receptacle including, a case defining a storage space configured to accommodate the plurality of grommets, and an opening in communication with the storage space, the opening configured to hold a respective one of the grommets in an installation position in which a first portion of the respective one of the grommets protrudes through the opening and a second portion of the respective one of the grommets is located in the storage space; and a biasing structure movably mounted in the case and configured to bias each of the grommets in the storage space toward the installation position, wherein the biasing structure includes, a plug that has a first end and a second end, a first spring adjacent to the second end of the plug, a spring adapter that is attached to the first spring, and a second spring that is attached to the spring adapter such that the second spring extends from the spring adapter and abuts an end of the receptacle, and the plurality of grommets are adjacent the first end of the plug.

2. The installation tool of claim 1, wherein the biasing structure further includes, a plug that has a first end and a second end, a first spring that has a first end and a second end, and the first end of the first spring is connected to the second end of the plug, a spring adapter that is connected to the second end of the first spring, and a second spring that is connected to the spring adapter, the plug is configured to move through the storage space as first spring and the second spring expand and contract.

3. The installation tool according to claim 2, further comprising:

a grip connected to the plug and configured to move toward and away from the opening in the receptacle along an axial direction of the receptacle between a loading position and an empty position; and a locking structure configured to selectively retain the grip in the empty position when the locking structure engages the grip, wherein the plug is spaced away from the opening in the receptacle by a first distance along the axial direction when the grip is in the loading position, and the plug is spaced away from the opening in the receptacle by a second distance along the axial direction when the grip is in the empty position, and the second distance is smaller than the first distance.

4. An installation tool for installing a plurality of grommets into a hole in a vehicle panel, each of the grommets includes a first portion that is configured to pass through the hole in the vehicle panel and a second portion opposed to the first portion and configured to engage the vehicle panel such that the vehicle panel is sandwiched between the first portion and the second portion of the grommet when installed on the vehicle, the installation tool comprising:

a grommet receptacle that has a longitudinal axis and includes, a first end and a second end spaced apart along the longitudinal axis, a storage space configured to accommodate the plurality of grommets between the first end and the second end and aligned along the longitudinal axis, and an opening in the first end and in communication with the storage space, the opening configured to hold a respective one of the grommets in an installation position in which the first portion of the respective one of the grommets protrudes through the opening and the second portion of the respective one of the grommets is located in the storage space;

a biasing member abutting the second end of the grommet receptacle and configured to bias the grommets toward the opening;

a first slot extending along the grommet receptacle in a direction that is parallel to the longitudinal axis; and a movable grip slidable along the grommet receptacle and including a guide protruding into the first slot, wherein the first slot limits movement of the grip between the first end and the second end.

5. The installation tool of claim 4, wherein the grommet receptacle includes, a hollow case, and the storage space is defined by the case, a first cap that is attached to the case and includes the opening in the first end of the grommet receptacle.

6. The installation tool of claim 5, wherein the grommet receptacle further includes a second cap that is attached to the case and the second cap closes the second end of the grommet receptacle.

7. The installation tool of claim 5, wherein the opening has a diameter that is greater than a first outermost diameter of the first portion of each of the grommets and less than a second outermost diameter of the second portion of each of the grommets, the first cap includes, an inner cylindrical surface that engages and is fixed to an outer surface of the case, and a curved surface that extends away from the cylindrical surface and to the opening such that the curved surface tapers toward the opening, and the second portion of the respective one of the grommets engages the curved surface when the respective one of the grommets is held in the installation position.

8. The installation tool of claim 4, wherein the opening has a diameter that is greater than a first diameter of the first portion of each of the grommets and less than a second diameter of the second portion of each of the grommets, the receptacle includes a first cap having, an inner cylindrical surface that engages and is fixed to an outer surface of a case, and a radial surface that extends inwardly from the inner cylindrical surface, and the second portion of the respective one of the grommets abuts the radial surface when the respective one of the grommets is held in the installation position.

9. The installation tool of claim 4, wherein the grommet receptacle includes a cylindrical outer surface and the first slot passes through the outer surface, the grip includes, a hollow cylindrical sleeve that slides along the outer surface of the grommet receptacle, and the guide is fixed to the cylindrical sleeve and extends into the first slot, the first slot includes a first axial slot portion that extends parallel to the longitudinal axis and a first intermediate slot portion that extends from the first axial slot portion in a circumferential direction about the cylindrical outer surface, the sleeve is movable between a first position and a second position along the first axial slot portion and the sleeve is rotatable about the longitudinal axis between the second position and a third position spaced from the second position along the first intermediate slot portion, and the biasing member is connected to the sleeve and biases the sleeve along the longitudinal axis toward the opening in the grommet receptacle such that the biasing member biases the respective one of the grommets into the installation position when the guide is in the first axial slot portion.

10. The installation tool of claim 9, wherein the first slot includes a first lock slot portion that extends at an angle from the first intermediate slot portion, the first lock slot portion is spaced away from the first axial slot portion, and the first lock slot portion terminates at a first lock end that is spaced away from the first intermediate slot portion in a direction along the longitudinal axis, and the biasing member biases the guide against the first lock end when the guide is located in the first lock slot portion such that the sleeve is locked against rotational movement about the longitudinal axis and is locked against move toward the opening along the longitudinal axis.

11. The installation tool of claim 10, further comprising:

a second slot extending along the grommet receptacle in a direction that is parallel to the longitudinal axis, the second slot spaced away from the first slot, the second slot includes, a second axial slot portion that extends parallel to the longitudinal axis, a second intermediate slot portion that extends at an angle with respect to the second axial slot portion, and a second locking slot portion that is parallel to the second axial slot portion, and extends from the second intermediate slot portion such that the second locking slot portion is spaced away from the second axial slot portion, and terminates at a second lock end that is spaced away from the second intermediate slot portion in a direction along the longitudinal axis; and a plug movably located in the storage space and having a first end and a second end, wherein the guide is connected to each of the sleeve and the plug and extends through each of the sleeve, the plug, the first slot and the second slot, the first slot and the second slot together limit movement of the grip between the first end of the receptacle and the second end of the receptacle, the first end of the plug is configured to abut a last one of the grommets, and the biasing member abuts the second end of the plug and biases the plug toward the opening.

12. The installation tool of claim 4, further comprising:

a second slot spaced away from the first slot extending along the grommet receptacle in a direction that is parallel to the longitudinal axis, wherein the grip includes a pair of knobs and a fastener connected to each of the knobs and passing through each of the first slot and the second slot.

13. A method for installing grommets onto a vehicle, the method comprising:

providing the installation tool according to claim 1;

loading a plurality of grommets into the installation tool;

inserting a first of the grommets into a first aperture in a panel of the vehicle;

removing the installation tool from the panel after inserting the first grommet in the first aperture in the panel such that the first grommet remains in the first aperture in the panel of the vehicle;

inserting a second of the grommets into a second aperture in the panel of the vehicle; and removing the installation tool from the panel after inserting the second grommet in the second aperture in the panel such that the second grommet remains in the second aperture in the panel of the vehicle.

14. The method according to claim 13, further comprising:

repeating the inserting and the removing until all of the grommets in the installation tool have been installed into respective apertures in the panel of the vehicle, and loading a second plurality of grommets into the installation tool after all of the plurality of grommets have been installed into the panel of the vehicle.

15. The method according to claim 13, wherein loading includes:

sliding a sleeve that is mounted to a case of the installation tool along a longitudinal axis of the case, and locking the sleeve in a loading position by rotating the sleeve about the longitudinal axis of the case into a locked position.

16. The method according to claim 13, wherein the steps of inserting a first of the grommets into a first aperture, removing the installation tool from the panel, inserting a second of the grommets into a second aperture in the panel of the vehicle, and removing the installation tool from the panel after inserting the second grommet in the second aperture occurs in continuous consecutive steps that includes moving a grip with respect to the receptacle along the longitudinal axis of the receptacle and includes no intermediary step of the user operating or moving any structure other than the grip of the installation tool to unlock or release or move the grommets.

17. The installation tool of claim 1, further comprising:

a first slot extending along the case in a direction that is parallel to a longitudinal axis of the case; and a movable grip slidable along the case and including a guide protruding into the first slot, wherein the first slot limits movement of the grip between a bottom end of the receptacle and the opening of the receptacle.

* * * * *